United States Patent [19]

Barkans

[11] Patent Number: 4,876,533

[45] Date of Patent: Oct. 24, 1989

[54] METHOD AND APPARATUS FOR REMOVING AN IMAGE FROM A WINDOW OF A DISPLAY

[75] Inventor: Anthony C. Barkans, Woburn, Mass.

[73] Assignee: Schlumberger Technology Corporation, Houston, Tex.

[21] Appl. No.: 259,474

[22] Filed: Oct. 18, 1988

Related U.S. Application Data

[63] Continuation of Ser. No. 915,502, Oct. 6, 1986, abandoned.

[51] Int. Cl.[4] ..... G09G 1/06

[52] U.S. Cl. ..... 340/721; 340/701; 340/703

[58] Field of Search ..... 340/701, 703, 730, 734, 340/721, 723, 724; 358/183

[56] References Cited

U.S. PATENT DOCUMENTS

| | | | |
|---|---|---|---|
| 3,911,418 | 10/1975 | Takeda | 340/730 |
| 4,016,544 | 4/1977 | Morita et al. | 340/703 |
| 4,352,100 | 9/1982 | O'Connell | 340/734 |
| 4,467,322 | 8/1984 | Bell et al. | 340/703 |
| 4,481,594 | 11/1984 | Staggs et al. | 340/703 |
| 4,591,842 | 5/1986 | Clarke, Jr. et al. | 340/703 |
| 4,599,610 | 7/1986 | Lacy | 340/721 |
| 4,628,305 | 12/1986 | Ikeda | 340/703 |
| 4,673,929 | 6/1987 | Nelson et al. | 340/703 |
| 4,710,761 | 12/1987 | Kapur et al. | 340/721 |

*Primary Examiner*—David K. Moore
*Assistant Examiner*—Jeffery A. Brier
*Attorney, Agent, or Firm*—Ladas & Parry

[57] ABSTRACT

An image within a window on a scanned display device driven by a video generator is replaced with a preselected background color within one frame. The contents of the memory used to refresh the display can thus be changed in a background mode so that the user is unaware of the operation which he or she perceives as "instantaneous". Circuitry determines whether the scan is within the boundaries of the window and, if it is, generates a forcing signal which directs a look-up table within the video generator to a predetermined address which corresponds to a preselected background color. The invention can utilize existing circuitry in the video generator for generating synchronizing and blanking signals.

20 Claims, 4 Drawing Sheets

METHOD AND APPARATUS FOR REMOVING AN IMAGE FROM A WINDOW OF A DISPLAY

This is a continuation of co-pending application Ser. No. 915,502, filed on Oct. 6, 1986, now abandoned.

BACKGROUND OF THE INVENTION

This invention relates to a method and apparatus for removing an image from a window of a display and displaying only the background color. In particular, it pertains to the removing of an image from within a window of a CRT raster-scanned display device and especially to such a display when used in a computer graphics system.

The typical display device for a computer system, the CRT, is a raster-scanned device which has no inherent memory. The image that is to appear each time the raster is scanned must be generated by an outside source. Where this image is to be maintained on the screen, such as in a computer graphics system, the information is typically stored in a digital memory. Semiconductor memories are now low enough in cost that raster-scanned frame-buffer memories are commonly used. In a frame-buffer memory, each location in the memory corresponds to one picture element on the screen, hereinafter referred to by its common technical term "pixel". This type of memory allows the display hardware to be insentitive to the image content, an arbitrary image can be displayed by properly recording the data at each location in the frame-buffer memory. If it is only necessary to store the presence or absence of illumination of that particular pixel, a two-dimensional memory array is sufficient. If, however, it is desired to control the intensity of the illumination and/or the color of that particular pixel, then a three-dimensional memory is required. In the three dimensional memory, each location stores a word which is used to store the information to control the intensity and/or color of the pixel. Each time the raster on the CRT is scanned, the video signal to refresh the display is generated from the memory.

When it is desired to remove an image, which may include text and graphics from the screen, the content of the screen frame-buffer memory must be changed. In the prior art, it is possible to apply a blanking signal to the CRT to drive the entire display to black. The blanking signal is the signal that is normally applied to the CRT during the horizontal and vertical retrace periods so that the retrace does not appear on the screen. The contents of the frame-buffer memory can now be changed in the background without the user's knowledge.

Recently the use of windows has become common in order to display the results of several tasks on the screen at any one given time. A window may be defined as an area on the screen of predetermined shape into which data is written and which operates independent of the other areas on the display. In its most common form, windows are rectangular shapes which may be overlayed one on top of the other so that portions of one window may be covered by another. This provides a very cost effective technique for displaying and controlling a multiple number of tasks on a single screen.

When it is time to remove the image from one particular window, the blanking technique described above cannot be utilized because it blanks the entire screen. In addition, color monitors have now become popular. It may therefore be desirable that the window display a chosen background color rather than going to black. Presently, removing the image from a window is accomplished by erasing the data stored in the frame-buffer memory while the. frame-buffer memory is being utilized to refresh the display. When compared with the normal operating times of computer functions, this is a relatively slow operation because it commonly requires several frames to complete. Therefore, the user observes the slow erasure of the image from the screen. In addition, in some systems in which a color display is utilized, the image is not erased at a constant speed because erasing some colors requires changing more memory locations than erasing others. This operation can be annoying to the skilled user. More importantly, the inventor has discovered that it gives the user the impression that the system is unresponsive even though that it is not the case.

SUMMARY OF THE INVENTION

It is a general object of the present invention to provide a method and apparatus for removing the image from a window on a display and displaying only a background color.

Another object of the invention is to remove the image from a window on a display without the process being visible.

A further object of the invention is to change the informational content of a window on the display to the chosen background color within one frame.

These and other objects, advantages and features are achieved by a method for removing the image from a selected area of a scanned display device driven by a video generator and replacing said image with a predetermined background color. The boundary locations of said selected area are identified and the current position of the scan on the display device is determined. The current position of said scan is compared with said boundary locations to determine whether said current position of said scan is inside said selected area. A forcing signal is generated for said video generator to drive said display to said preselected background color when said scan is within said selected area.

Another aspect of the invention includes an apparatus for removing the image from a selected area of a scanned display device driven by a video generator and replacing said image with a predetermined background color. Identifying means identifies the boundary locations of said selected area; determining means determines the current position of the scan on the display device. Comparing means compares said current position of said scan to said boundary locations to determine whether said current position of said scan is inside said selected area. Generating means generates a forcing signal to drive said display to said preselected background color when said scan is within said selected area.

A further aspect of the invention includes a computer system comprising computer means for generating data representative of images to be displayed. A frame-buffer memory means is coupled to said computer means for storing said data. A video generator means is coupled to said memory means with an output of said video generator means being coupled to a raster-scanned display. Said display is refreshed by said video generator means utilizing data stored in said memory means. A forcing means is coupled to said video generator for removing an image from a selected area of said display and replacing it with a predetermined background color within one frame.

Yet another aspect of the invention includes a method for removing the image around a selected area of the scanned display device driven by a video generator and replacing said image with a predetermined background color The boundary locations of said selected areas are identified and the current position of the scan on the display device is determined. The current position of said scan is compared with said boundary locations to determine whether said current position of said scan is inside the selected area.

A forcing signal is generated for said video generator to drive said display to said pre-selected background color when said scan is not within said selected area.

DETAILED DESCRIPTION

Figure 1:
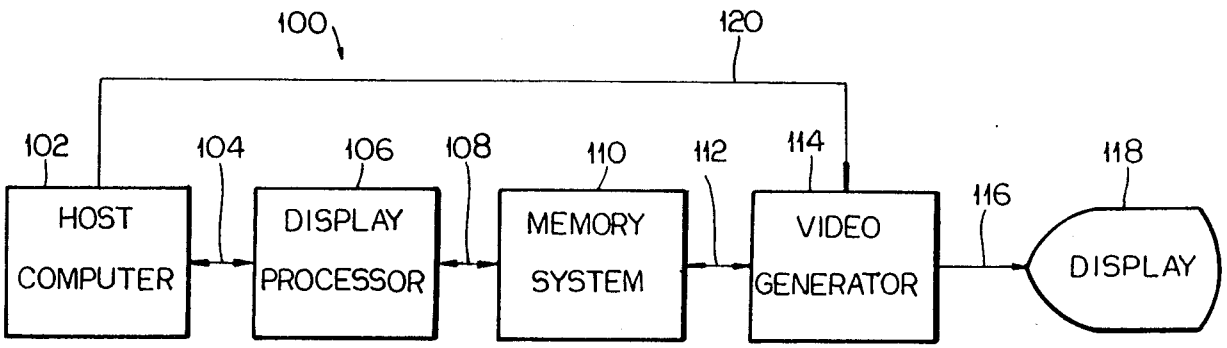
FIG. 1 is a simplified block diagram of a generalized computer graphics system.

FIG. 1 is a simplified block diagram of a generalized computer graphics display system utilizing a frame-buffer memory. Host computer 102 is coupled via bidirectional bus 104 to display processor 106. The display processor 106 is coupled via bidirectional bus 108 to a memory system 110. Memory system 110 is coupled via bidirectional bus 112 to video generator 114 which is coupled via bus 116 to the display 118. In the system shown in FIG. 1 which is representative of some systems, the frame-buffer, here shown as memory system 110, is not directly accessible to a host computer program. Instead, the frame-buffer memory is controlled by a display processor. This processor typically appears to the host as another input-output device. In a computer graphics system, the display processor can perform graphics functions such as writing lines or inserting text characters which are part of the graphics image into the frame-buffer memory for display on the CRT. The display processor would also include necessary memory control and rasterizing functions in order to perform these operations.

The frame-buffer 110 includes a multidimensional memory array in which each location in memory corresponds to a pixel on the screen. As described above, the multi-dimensional array can be a two-dimensional array or a three-dimensional array.

Video generator 114 reads out memory 110 in order to provide the refreshed data to the display 118 over bus 116. The video generator 114 also includes a digital-to-analog converter to convert the digital information stored in memory 110 into an analog signal which can be used by display 118. One common form of digital-to-analog converter utilized in this type of system utilizes a look-up table in which the information stored in the frame-buffer memory 110 is used to access a location in a table the output of which is then utilized by the digital-to-analog converter to generate the analog output. The use of a look-up table allows for linearizing of the signal because of the non-linear nature of the digital-to-analog converter. The changing of data in the look-up table for another set of data also allows changes in the shading of an image without the need to change the information stored in the frame-buffer memory 110. Video generator 114 also contains the circuitry to generate the synchronization and blanking pulses utilized by the display in a manner well known to those skilled in the art.

The CRT display 118 includes all the necessary power supplies and scanning circuits, as are well known to those skilled in the art.

FIG. 1 also illustrates the use of a blanking signal to blank the entire screen of the CRT, as described above. Line 120 couples the blanking control signal from host computer 102 to video generator 114. When it becomes desirable to blank the screen, the host computer sends the control signal over line 120 to instruct the video generator 114 to generate a blanking level video signal to the display. The host computer 102 also instructs the display processor 106 via bus 104 to erase the contents of memory system 110. In some systems, display processor 106 may directly access the memory of memory system 110 via bus 108 and erase the data stored at each location in the memory. In other embodiments, the display processor 106 would command a pixel processor (not shown) in memory system 110 via bus 108 to perform the erasing function. In either event, the erasing of the data in memory 110 would occur without the viewer's knowledge since the screen is blanked. Once the erasing process has been completed, the host computer can command the video generator again over line 120 to stop the blanking function. New data can be written into the memory system to provide a different display on the CRT.

Figure 2:
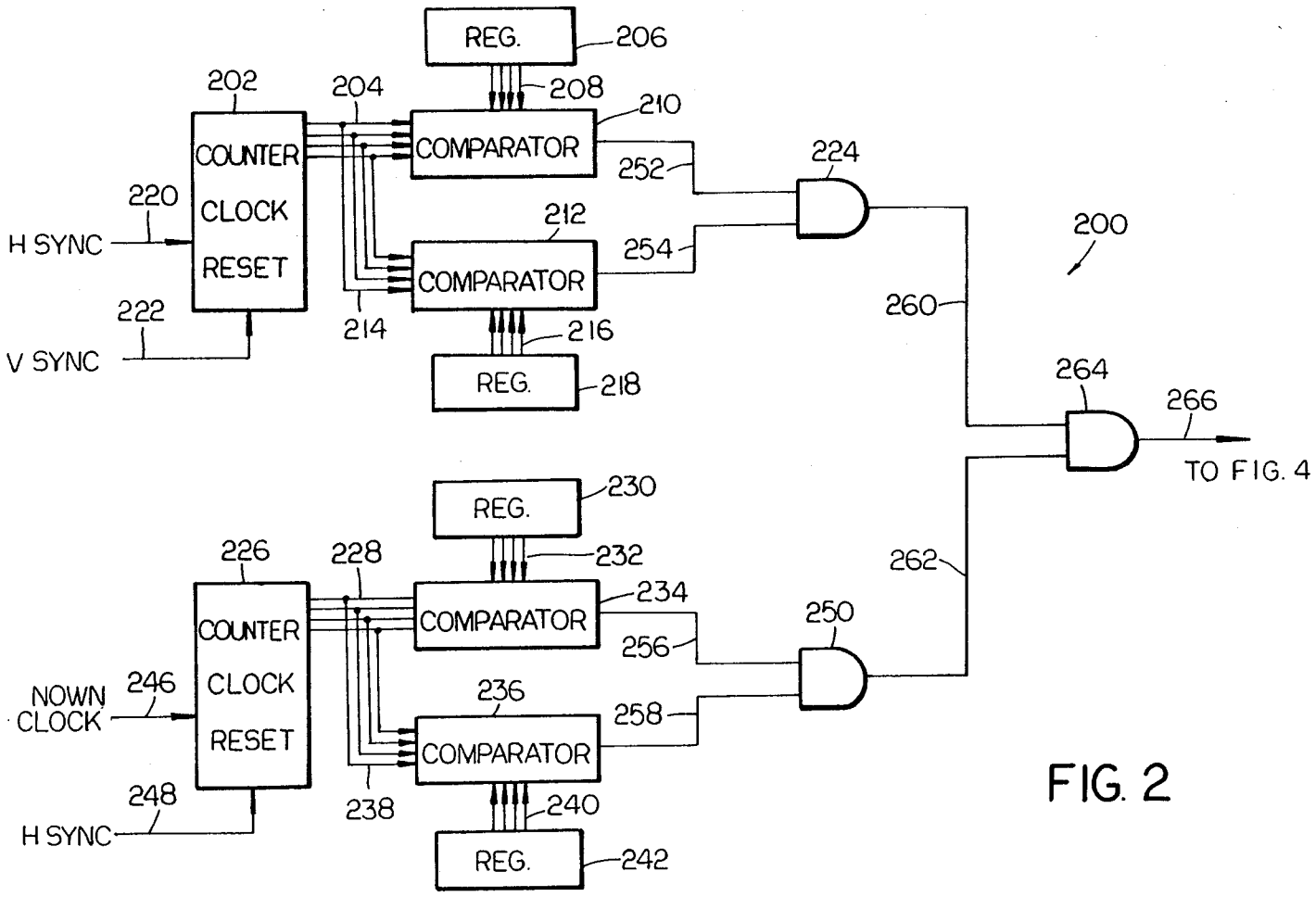
FIG. 2 is a block diagram of the scan position locating circuitry in accordance with the present invention.
Figure 3:
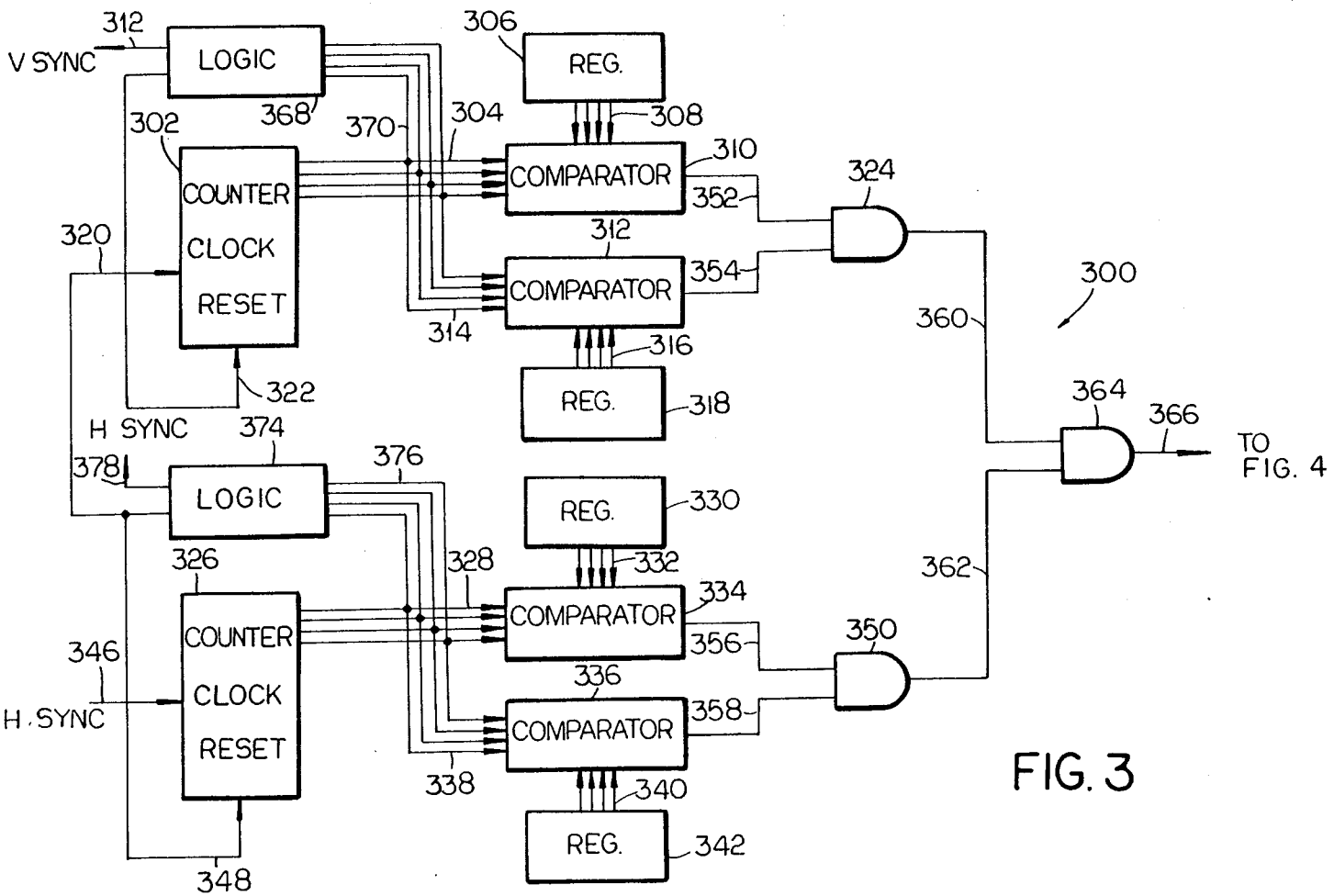
FIG. 3 is a modified version of the circuitry shown in FIG. 2; .
Figure 4:
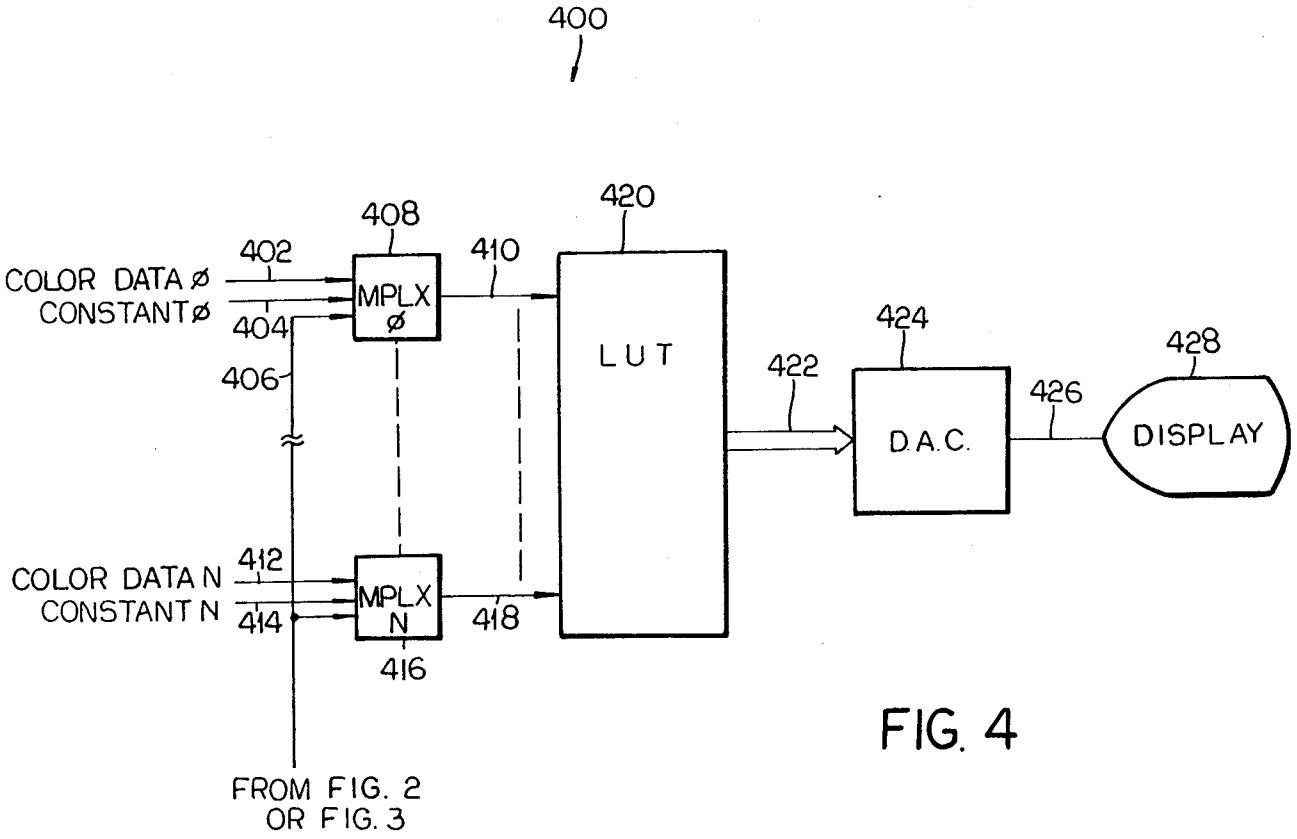
FIG. 4 is a block diagram of the forcing signal generating circuitry for use with the circuitry of FIG. 2 or FIG. 3.

FIGS. 2,3, and 4 show the circuitry necessary to remove an image from a window on the screen of a CRT and replace the image with a preselected background color within one frame. The circuitry shown in FIGS. 2, 3, and 4, except for the display 428 shown in FIG. 4, are contained within the video generator 114 shown in FIG. 1. Referring briefly to FIG. 4, the display 428 is driven by a digital-to-analog converter (DAC) 424 which generates an analog signal from the digital signal presented to it on bus 422. This analog signal is coupled via line or bus 426 to display 428 for display on the screen of the CRT. The digital signal on bus 422 comes from a look-up table (LUT) 420 as was described above. Ignoring, for the moment, the multiplexers 408 and 416, the inputs to the LUT are the color data inputs such as 402 and 412 which come from memory system 110. In a typical memory system, the memory is a frame-buffer memory which is three-dimensional. Each plane of the memory stores one bit which represents a single color or shade or the illumination level for each pixel on the screen of the CRT. Each one of these planes is coupled to one of the inputs such as 410 and 418 to the LUT. A typical system with 8 color planes would be able to display 256 shades of color at any given time out of a possible palet of 16.7 million shades. The use of the LUT enables the selected colors to be changed by changing the contents of the memory of the LUT which is typically a random access memory (RAM). Thus by merely changing the contents of the LUT, without changing the contents of the data stored in the memory system 110, the shading of the image can be changed. In, addition, it is possible to put the code for a preselected background color into a chosen location in the LUT so that the background color can be changed without changing the representation in the memory system 110 for the background color.

Referring now to FIG. 2, circuitry for determining whether or not the position of the scan is within or at the boundaries of the window is shown generally as 200. The circuitry 200 comprises a vertical position counter 202 and a horizontal position counter 226. Counter 202 has a clock input 220 which advances the counts in the counter by one count for each pulse of the clock signal. In addition, the counter 202 has a reset input 222 which resets the count in the counter to zero. For purposes of illustration only, the counter 202 is shown as having four output lines 204 which represents the outputs of the stages of the counter. In actual practice, many more stages than four are required for a reasonably sized display, although it is not always necessary for the outputs of all of the stages to be available to the remainder of the circuitry. Output lines 204 are connected to the input of a top of the window comparator 210 which compares the output of the counter with the value stored in a register 206 and coupled to the comparator by lines 208. For systems in which the top line of the raster is scanned first, the output of the comparator on line 252 is a digital 1, representing a true condition, if, and only if, the output of the counter on lines 204 is greater than or equal to the value stored in register 206.

The output of the counter on lines 204 is also coupled via lines 214 to bottom of the window comparator 212. The value on lines 214 is compared by comparator 212 with the value stored in register 218 and coupled to the comparator by lines 216. The output of comparator 212 on line 254 will be a digital 1 indicating a true condition, if and only if, the value on line 214 is less than or equal to the value stored in register 218. Register 206 is loaded with the vertical position corresponding to the top of a rectangular window and register 218 is loaded with the vertical position corresponding to bottom of a rectangular window by means not shown. Counter 202 is clocked by the horizontal synchronizing signal (HSYNC) on clock line 220 to count the number of completed horizontal lines scanned on the display. The counter is reset by the vertical synchronizing signal (VSYNC) on line 222 which indicates that a complete field has been scanned. As is well known to those skilled in the art, the HSYNC and VSYNC signals are required for the operation of the CRT display and are generated by the video generator 114 by means not shown. Thus, the circuitry described so far counts the number of horizontal lines that have been scanned, compares them against a top and bottom of a rectangular window and sends true signals on lines 252 and 254 to two-input AND gate 224 only when the scan is between the desired top of the window and the desired bottom of the window. When these two conditions are met, the output of AND gate 254 is a digital 1 on line 260 which is coupled to one input of two-input AND gate 264.

Similarly, counter 226 is coupled to a known clock on clock line 246 and is reset by the HSYNC signal on line 248. The output of the counter on lines 228, again shown for purposes of illustration only, as four lines representative of the outputs of four stages of the counter, is connected to the input of left side comparator 234. The output of counter 226 is also connected via lines 238 to the input of right side comparator 236. Comparator 234 compares the output of the counter with the value stored in register 230 and coupled to the comparator via lines 232. For systems in which the scan starts from the left side of the screen, the output of the comparator 234 will be a digital 1 on line 256 if, and only if, the value on lines 228 is greater than or equal to the value stored in register 230. Similarly, the output of comparator 236 on line 258 will be a digital 1 if, and only if, the value on lines 238 is less than or equal to the value stored in register 242.

The clock input to counter 226 is coupled via line 246 to a known clock which is related to the horizontal position of the scan. For this purpose it is convenient to use the pixel clock which has one clock cycle for each pixel to be displayed on the screen. This signal is normally required for the operation of the computer graphics system in order to clock out the data utilized to display that pixel. The count in counter 226 is thus representative of the horizontal position of the scan at any given time. This counter is reset to zero by the HSYNC signal coupled to the reset input of the counter by line 248. This resets the output of the counter when the scanning of the horizontal line is completed. Thus, the output of the counter is compared by comparator 234 with the horizontal position of the left side of the rectangular window stored in register 230 and compared by comparator 236 with the value of the right side of the rectangular window stored in register 242. Output signals 256 and 258 are at a digital 1 indicating a true position when the scan is between the left and right sides of the window. These signals are coupled to two-input and AND GATE 250 which has an output on line 262 which is a digital 1 indicating a true condition when the scan is between the left and right sides of the window. Line 262 is coupled to the second input of AND GATE 264 which has an output on line 266 when the inputs on lines 260 and 262 are digital ones indicating that the scan is between the upper and lower limits and left and right side limits of the rectangular window. Thus, the signal on line 266 is true only when the scan is within the limits of the window or at its borders. The circuitry illustrated in FIG. 2 will make this determination only for windows of rectangular shape having four boundaries. If, for example, one window is overlaid on top of another, as is common on computer displays, there will be more than four boundary conditions which will require that the output of the two counters be compared by additional comparators having registers storing the value to be compared against. The outputs of these counters will be additional inputs to the AND gates 224 and 250.

FIG. 4 shows the utilization of the signal on line 226 by the reminder of the circuitry in the video generator 114 in order to remove the image within the window and replace it with the background color within one frame. The connection of the LUT, DAC and the display was discussed above. The inputs to the LUT are the color data inputs which come from the memory system 110. These are shown as lines 402 and 412 for color data line 0 and color data line N, respectively.

It is common to have twelve color planes in some systems, so that N would equal 12. These color data inputs are inputted to multiplexer circuits such as multiplex circuit 0, block 408, through multiplex circuit N, block 416. The other input to the multiplexer circuits are constants shown as constant 0 for multiplexer 0 and constant N for multiplexer N. The multiplexers are operated by a signal on line 406 which is connected to the signal on line 266 in FIG. 2. When the scan line is outside of the window, the signal on line 266 and thus on line 406 is a zero and the color data inputs to the multiplexers are input through the LUT via lines 410 and 418. The system thus operates normally. When the scan is within the window or at its borders, the signal on line 266 and therefore on line 406 is a digital 1 which causes the multiplexers to feed the constant values to the LUT via lines 410 and 418. The values of the constants for each input line may be different and correspond to the address of the chosen background color. Thus, within a single frame all of the pixels within a window or at its borders will be scanned and replaced with the chosen background color. Notice that by inverting the signal on line 266 and thus on line 406 we can leave the image within the window untouched and change everything outside the window to the chosen background color. It should also be noted that, while the contents of the window have been replaced with a chosen background color, the data stored in memory 110 is unchanged and must still be changed in a background mode as was done in the prior art.

Referring now to FIG. 3, a modified form of the circuitry determining whether or not the position of the scan is within the boundaries of the window is shown generally as 300. Those features that are the same as the features shown in FIG. 2 have been given the same reference number with the exception of the first numeral which is changed to a 3. In the circuitry shown in FIG. 3, counter 326 is clocked by a known clock on line 346. This known clock can be the pixel clock, or another clock which is related to the horizontal position of the scan. The output of the counter, in addition to being coupled to comparators 334 and 336, is also coupled to logic circuit 374 by lines 376. An output of logic circuit 374 is coupled via line 348 to the reset input of counter 326. Another output of logic circuit 374 is the horizontal synchronizing signal, HSYNC, on line 378. The output on line 348 is also coupled, via line 320 to the clock input of counter 302. The output line of counter 302, in addition to being coupled to comparators 310 and 312, is coupled to logic circuit 368 via lines 370. An output of logic circuit 368 is coupled via line 322 to the reset input of counter 302. Another output of logic circuit 368 is the vertical synchronizing signal, VSYNC, on line 372.

In operation, counter 326 is clocked by the signal on line 346 to generate a signal representative of the horizontal position of the scan. When the counter reaches a predetermined count which is representative of the end of a horizontal line, logic circuit 374 generates a signal on line 378 which becomes the horizontal synchronizing signal, HSYNC, for the system. One or more counts of the counter 326 later, the logic circuit 374 generates a signal on line 348 which resets counter 326 to zero. The process will then repeat for each horizontal line thereafter. The signal on 348 used to reset counter 326 is also utilized as a clock signal for the counter 302. Every time a horizontal line of the raster is scanned, the counter 302 will be advanced by one count. Thus, counter 302 counts the number of horizontal lines scanned to generate the vertical position of the scan. When the count in counter 302 reaches a predetermined number, representative of the number of horizontal lines in the raster, logic circuit 368 generates a vertical synchronizing signal, VSYNC, on line 372 which becomes the vertical synchronizing signal for the system. One or more counts later the logic circuit 368 generates a signal on line 322 which resets counter 302 to zero. The process repeats for each field of the raster. The reason for having logic circuits 374 and 368 generate the reset signal one or more counts after the synchronizing signals have been generated, is to avoid a critical timing situation which can lead to unstable operation of the circuit.

Those skilled in the art will recognize that it is necessary to generate the HSYNC and VSYNC signals in any display utilizing a CRT. In a typical system, these signals are generated by counting signals related to the horizontal and vertical position of the scan. Thus, counters such as 302 and 326 are required in the video generator in order to generate these signals. In some systems, they may be part of a CRT controller integrated circuit which may or may not have the outputs necessary for the present invention available at the pins of the integrated circuit. In addition, logic circuits 368 and 374 would also be utilized to generate the horizontal and vertical blanking signals which are required to operate the CRT. These signals would be generated at predetermined counts within the counters 302 and 326 respectively. As is well known to those skilled in the art, the synchronizing signals occur in the middle of the blanking signals so that the counter would not, in fact, be reset until the blanking signal was completely generated.

As will be apparent to those skilled in the art, the present invention only requires the addition of four comparators, four registers, and three two-input AND gates in order to generate the signal which determines whether the scan is within the window or at its borders. In typical systems today, the video generator circuit 114 contains one or more gate array integrated circuits. The comparators, registers and AND gates can easily be accomodated by these gate array integrated circuits at very low cost.

The circuit of FIG. 3 generates a signal on line 366 which is coupled to the circuitry of FIG. 4. The circuitry of FIG. 4 operates in an identical fashion as described above in conjunction with the signal generated by FIG. 2. However, there is one additional simplification that can be made to the circuit shown in FIG. 4 in order to reduce the cost of implementation. As stated above, the LUT is a RAM which contains the color information and/or the illumination level information for the display. The purpose of the multiplexers 408, 416 was to enable a preselected address to be input to the LUT to select a background color. However, because the LUT is a RAM, we can choose the location of the background color to be the zero location in the memory. In this case, the constants coupled to the multiplexers 408, 416 would be zero. However, it is not necessary to couple a zero to the multiplexer and, in fact, it is not necessary to use multiplexers for this purpose. The multiplexers 408, 416 can be replaced by two-input AND gates having one input coupled to the color data line for that input to the LUT and the other input coupled to line 406. The signal on line 406 would have to be inverted from the signal which would be utilized with the multiplexers. In operation, when the signal on line 366, or for that matter on line 266, is a logic 0 indicating that the scan is outside of the window, the signal on line 406 would be a logic 1. With a logic 1 applied to one input of the two-input AND gate, the color data information applied to the other input will be passed through to the LUT. Thus, the system will operate normally. When the signal on line 266 or 366 is at logic 1, indicating that the scan is within the window or at its borders, the signal on 406 will be a logic 0. With a logic 0 applied to one input of the two-input AND gate, a logic 0 will appear at the output lines which are coupled to the LUT, regardless of the input signal applied to the color data input. The LUT will be directed to the zero address which contains the desired background color. Thus, the multiplexers are replaced with the less costly two-input AND gates. These gates can also be contained within one of the gate array integrated circuits for the video generator 114. Therefore, the entire circuitry necessary to implement the present invention can be added with no increase in the number of integrated circuits required in the video generator circuit 114 and at practically no additional cost.

An additional feature of the present invention is the ability to remove the image and replace it with a background color without a "broken frame" effect. As is well known to those skilled in the art, it takes one frame to scan the entire active surface of the CRT screen. Therefore, replacing one image with another takes one frame time. If the system starts replacing an image during a frame, a portion of the image will be replaced during that frame and the remainder will be replaced in the following frame. In non-interlaced scanning, as used in computer graphics displays, it appears that the vertical synchronization is off so that the frame containing the image is broken and a portion appears in each of two successive frames. Hence the term "broken frame" effect. In the worst case example, the system starts replacing the image in the middle of the frame causing half of the image to be removed in the first frame and half in the next frame. Even though there are typically 30 or 60 frames per second, the effect can be noticeable and distracting to an experienced operator.

In order to avoid this effect, the system is designed to only enable the circuitry that removes the image and replaces it with a background color during vertical retrace periods. This can be accomplished by programming the host computer or display processor to only enable this circuitry during a vertical retrace period. Alternatively, the enable signal could be generated at any time but only applied to the circuitry during vertical retrace periods. A simple D type flip-flop having the enable signal applied to the D input and the vertical synchronizing signal applied to the clock input could perform this function. For example, the enabling of the circuitry could be controlled by applying the signal to the comparators or AND gates of FIGS. 2 and 3 or to the multiplexers or the AND gates used in place of multiplexers in FIG. 4.

While particular embodiments of the present invention have been disclosed herein, certain changes and modifications will readily occur to those skilled in the art. For example, the comparators could produce a logic 1 signal only when the value on the lines from the counters was less than (or greater than) but not equal to the value stored in its associated register. It should also be noted that black can be used as the background color. All such changes and modifications can be made without departing from the invention as defined by the appended claims.

I claim:

1. A method for removing an image from a selected area of a scanned display device driven by a video generator and replacing said image with a predetermined background color comprising the steps of:

(a) identifying the boundary locations of said selected area on a display to within a pixel independent of said video generator driving said display;

(b) determining the current position of the scan to within a pixel on the display device;

(c) comparing said current position of said scan to said boundary locations to determine whether said current position of said scan is inside said selected area; and (d) generating a forcing signal for said video generator to drive said display to said preselected background color when said scan is within said selected area.

2. A method of claim 1 wherein said selected area is a window of rectangular shape.

3. The method of claim 2 wherein said determining step comprises:

(a) counting the number of horizontal lines through which said scanning beam has passed since its last vertical reset, to determine the vertical position of the scanning beam; and (b) counting the number of vertical rows through which said scanning beam has passed within a given horizontal line, relative to a known pixel clock signal, to determine the horizontal position of the scanning beam at each point in its passage across the display device.

4. The method of claim 3 wherein said video generator comprises a look-up table having an output coupled to a digital-to-analog converter.

5. The method of claim 4 wherein said forcing signal directs said look-up table to a preselected address.

6. The method of claim 5 wherein said preselected address is the address in which all address bits are zero.

7. Apparatus for removing an image from a selected area of a scanned display device driven by a video generator and replacing said image with a predetermined background color comprising:

(a) a means for identifying the boundary locations of said selected area on a display to within a pixel independent of said video generator driving said display;

(b) means coupled to said identifying means for determining the current position of the scan to within a pixel on the display device;

(c) means coupled to said determining means for comparing said current position of said scan to said boundary locations to determine whether said current position of said scan is inside said selected area; and (d) means for generating a forcing signal to said video generator to drive said display to said preselected background color when said scan is within said selected area.

8. The apparatus of claim 7 wherein said selected area is a window of rectangular shape.

9. The apparatus of claim 8 wherein said means for determining comprises:

(a) a first counter for counting the number of horizontal lines which said scanning beam has passed since its last vertical reset, to determine the vertical position of the scanning beam; and (b) a second counter for counting the number of vertical columns through which said scanning beam has passed within a given horizontal line, relative to a known pixel clock signal, to determine the horizontal position of the scanning beam at each point in its passage across the display device.

10. The apparatus of claim 9 wherein said video generator comprises a look-up table having an output coupled to a digital-to-analog converter.

11. The apparatus of claim 10 wherein said forcing signal directs said look-up table to a preselected address.

12. The apparatus of claim 11 wherein said preselected address is the address in which all address bits are zero.

13. The apparatus of claim 12 wherein said look-up table comprises a random access memory (RAM).

14. The apparatus of claim 9 wherein the clock input to said first counter is coupled to the horizontal synchronization pulse for said display and the reset input of said first counter is coupled to the vertical synchronization pulse of said display; and the clock input to said second counter is coupled to said known clock signal and the reset input to said second counter is coupled to said horizontal synchronizing pulse.

15. The apparatus of claim 9 further comprising a first logic circuit coupled to the output of said second counter for generating a horizontal synchronizing pulse for said display device and a first reset signal coupled to a reset input of said second counter, said first reset signal being coupled to the clock input of said first counter; a second logic circuit coupled to the output of said first counter for generating a vertical synchronizing pulse for said display device and a second reset signal coupled to a reset input of said first counter; wherein said known clock signal is a pixel clock signal having one clock cycle for each pixel to be displayed on said display device.

16. The apparatus of claim 14 further comprising a first comparator coupled to a first register and to the output of said first counter, a second comparator coupled to a second register and to the output of the said first counter, said first register storing the upper boundary of said window, said second register storing the lower boundary of said window, said first comparator producing an output signal when said scan position is less than said top boundary, said second comparator producing an output signal when said scan position is greater than said lower boundary; and a third comparator coupled to a third register and to the output of said second counter; a fourth comparator coupled to a fourth register and to the output of said second counter, said third register storing the left-most boundary of said window, said fourth register storing the right-most boundary of said window, said third comparator producing an output signal when said scan position is less than said left-most boundary, said fourth comparator producing an output signal when said scan position is greater than said right-most boundary.

17. The apparatus of claim 16 wherein the output signals of said first and second comparators are ANDed to generate a vertical position signal; the output signals of said third and fourth comparators are ANDed to generate a horizontal position signal; and said vertical position and horizontal position signals are ANDed to generate said forcing signal.

18. A computer system comprising computer means for generating data representative of images to be displayed, a frame-buffer memory means coupled to said computer means for storing said data; video generator means coupled to said memory means, an output of said video generator means being coupled to a raster-scanned display, said display being refreshed by said video generator means utilizing data stored in said memory means; and forcing means coupled to said video generator for removing an image from a selected area having boundary locations identified to within a pixel on the scan of said display independent of said video generator and replacing it with a predetermined background color within one frame.

19. The apparatus of claim 18 wherein said video generator means comprises a look-up table having an output coupled to a digital-to-analog converter; said forcing means directing said look-up table to a preselected address.

20. A method for removing an image from a selected area of the scanned display device driven by a video generator and replacing said image with a predetermined background color comprising the steps of:

(a) identifying the boundary locations of said selected area on a display to within a pixel independent of said video generator driving said display;

(b) determining the current position of the scan to within a pixel on the display device;

(c) comparing said current position of said scan to said boundary locations to determine whether said current position of said scan is inside said selected area; and (d) generating a forcing signal to said video generator to drive said display to said predetermined background color when said scan is not within said selected area.

* * * * *